US007726294B2

(12) United States Patent
Collene et al.

(10) Patent No.: US 7,726,294 B2
(45) Date of Patent: Jun. 1, 2010

(54) MOTORIZED OVEN DOOR LATCH

(75) Inventors: James J. Collene, Nevada, OH (US); Nicholas R. SirLouis, Medina, OH (US)

(73) Assignee: Mansfield Assemblies Co., Mansfield, OH (US)

( * ) Notice: Subject to any disclaimer, the term of this patent is extended or adjusted under 35 U.S.C. 154(b) by 0 days.

(21) Appl. No.: 12/112,164

(22) Filed: Apr. 30, 2008

(65) Prior Publication Data

US 2008/0271727 A1 Nov. 6, 2008

Related U.S. Application Data

(60) Provisional application No. 60/927,421, filed on May 3, 2007.

(51) Int. Cl.
*F24C 14/00* (2006.01)
*F24C 14/02* (2006.01)

(52) U.S. Cl. ..... 126/197; 126/192; 292/95; 292/109; 70/275; 70/278.7; 70/318

(58) Field of Classification Search ..... 126/192, 126/197; 292/95, 109; 70/275, 278.7, 318
See application file for complete search history.

(56) References Cited

U.S. PATENT DOCUMENTS 4,163,443 A * 8/1979 Peterson ..... 126/197
4,189,632 A * 2/1980 Swanson et al. ..... 219/413
4,828,299 A * 5/1989 Poe ..... 292/139
4,838,586 A * 6/1989 Henne ..... 292/113
5,220,153 A * 6/1993 Malone et al. ..... 219/412
5,493,099 A * 2/1996 McWilliams, III ..... 219/413
6,302,098 B1 10/2001 Smith
6,315,336 B1 11/2001 Swartzell
6,474,702 B1 * 11/2002 Malone et al. ..... 292/97
6,698,418 B2 * 3/2004 Ramsey et al. ..... 126/197
7,029,040 B2 * 4/2006 Lippoldt et al. ..... 292/201
7,036,853 B2 * 5/2006 Smock et al. ..... 292/109
7,040,674 B2 5/2006 Lomicka et al.
7,066,503 B2 6/2006 Smith et al.
7,156,428 B2 1/2007 Smith
7,185,925 B2 3/2007 Courter et al.
7,225,804 B2 6/2007 Simmons, Jr. et al.
2005/0284464 A1 * 12/2005 Edwards et al. ..... 126/197
2006/0102166 A1 5/2006 Simmons, Jr. et al.
2006/0201928 A1 9/2006 Smith et al.
2007/0090655 A1 4/2007 Smith

* cited by examiner

*Primary Examiner*—Kenneth B Rinehart
*Assistant Examiner*—Jorge Pereiro
(74) *Attorney, Agent, or Firm*—Fay Sharpe LLP

(57) ABSTRACT

A motorized oven latch includes a base plate. A latch member is slidably connected to the base plate by a first mounting stud or first and second mounting studs connected to the latch member and located in a contoured slot defined in the base plate. The latch member includes an inner end and an outer end, and the outer end includes a hook adapted to engage an oven door. A motor is drivingly coupled to the latch member, and the motor is selectively operative to move the latch member forward and rearward relative to said base plate between a locked position and an unlocked position, wherein the latch member moves on a non-linear path relative to the base plate in response to movement of the first mounting stud or both the first and second mounting studs in the contoured slot when the motor moves the latch member forward to the unlocked position or rearward to the locked position.

18 Claims, 23 Drawing Sheets

MOTORIZED OVEN DOOR LATCH

CROSS-REFERENCE TO RELATED APPLICATION

This application claims priority from and benefit of the filing date of U.S. provisional patent application Ser. No. 60/927,421 filed May 3, 2007, and said prior application Ser. No. 60/927,421 is hereby expressly incorporated by reference into the present specification.

BACKGROUND

Motorized oven door latches are used to secure an oven door in a closed and locked position relative to a cooking chamber during a self-cleaning cycle or at other times as necessary to prevent opening of the oven door and access to the cooking chamber. A need has been identified for a new and improved motorized oven door latch with an improved structure for control and movement of the latch member, while still allowing for selective manual movement of the latch member to unlatch the oven door in the event of loss of power or other failure of the motorized oven door latch. Also, a need has been identified for a motorized oven door latch with reduced cost and complexity in terms of component cost and assembly.

SUMMARY

In accordance with one aspect of the present development, a motorized oven latch includes a base plate comprising a contoured slot. A latch member is movably connected to the base plate and is movable between a locked position and an unlocked position and includes an inner end and an outer end, wherein said outer end includes a hook portion. At least one mounting stud is connected to the latch member and is slidably located in the contoured slot. Outward sliding movement of the at least one mounting stud on a non-linear path in the contoured slot in response to movement of the latch member in an unlocking direction moves the latch member from the locked position to the unlocked position. Inward sliding movement of the at least one mounting stud on the non-linear path in the contoured slot in response to movement of the latch member in a locking direction moves the latch member from the unlocked position to the locked position. A motor is connected to said base plate and is operatively coupled to the latch member to selectively move the latch member in the unlocking and locking directions such that the latch member moves to and between its unlocked and locked positions in response to movement of the at least one mounting stud in the contoured slot.

In accordance with another aspect of the present development, an oven latch includes a base plate and a latch member slidably connected to the base plate by at least a first mounting stud connected to the latch member and located in a contoured slot defined in the base plate. The latch member includes an inner end and an outer end. A motor is drivingly coupled to the latch member and is selectively operative to move the latch member forward and rearward relative to the base plate between a locked position and an unlocked position, wherein the latch member moves on a non-linear path relative to said base plate in response to movement of the first mounting stud in the contoured slot when said motor moves said latch member forward to the unlocked position or rearward to the locked position.

DETAILED DESCRIPTION

Figure 3:
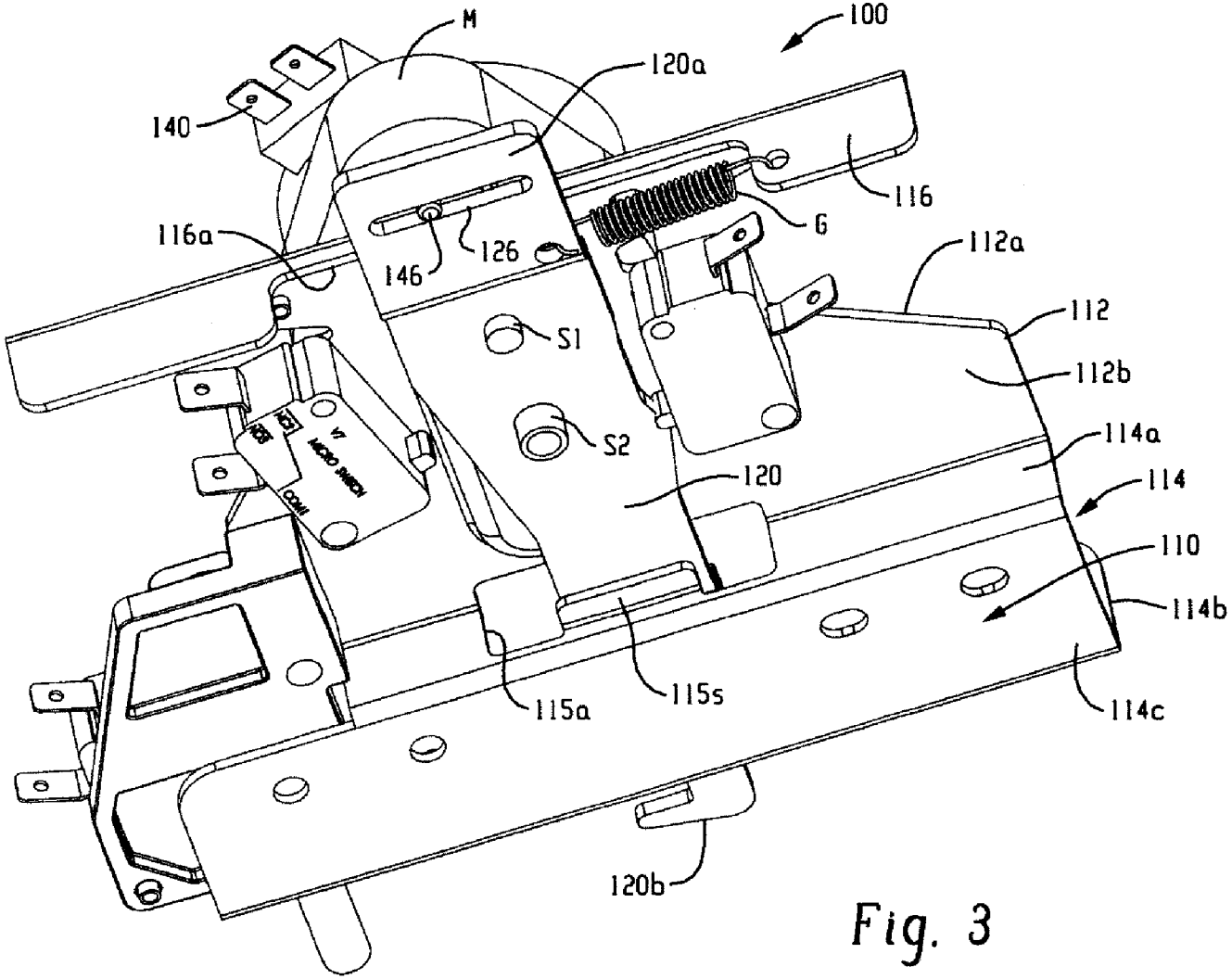
Figure 4:
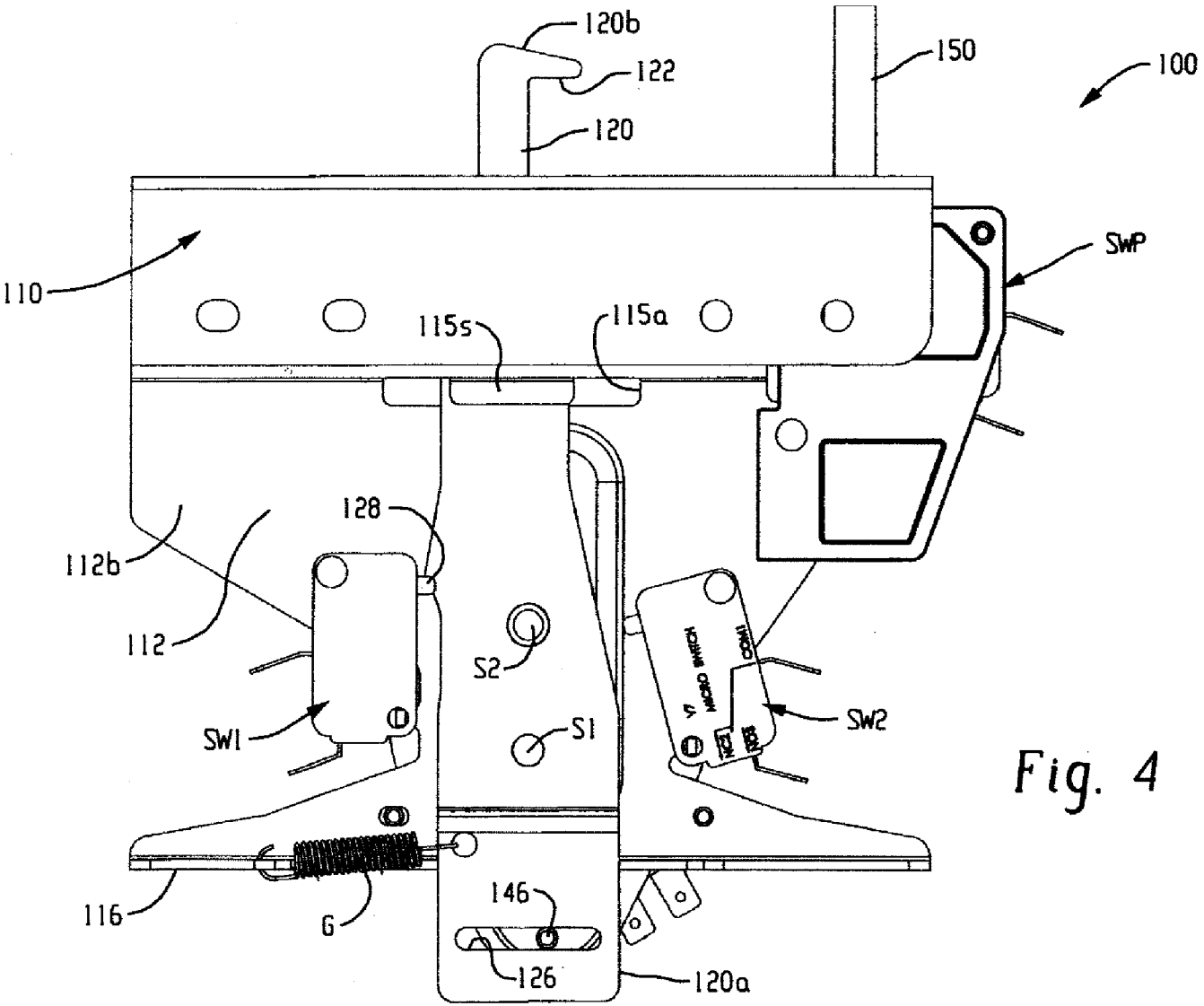
Figure 5:
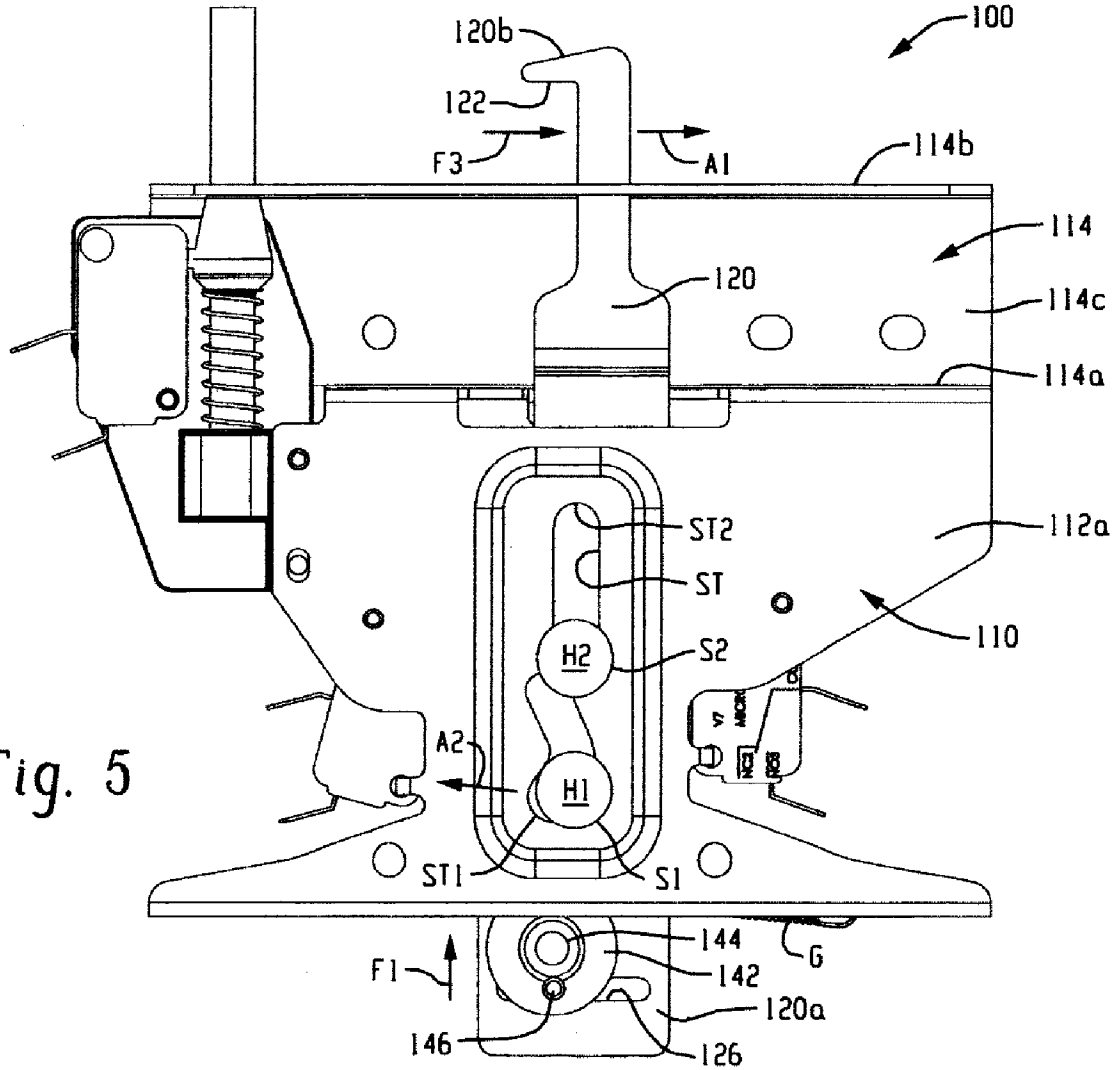
Figure 6:
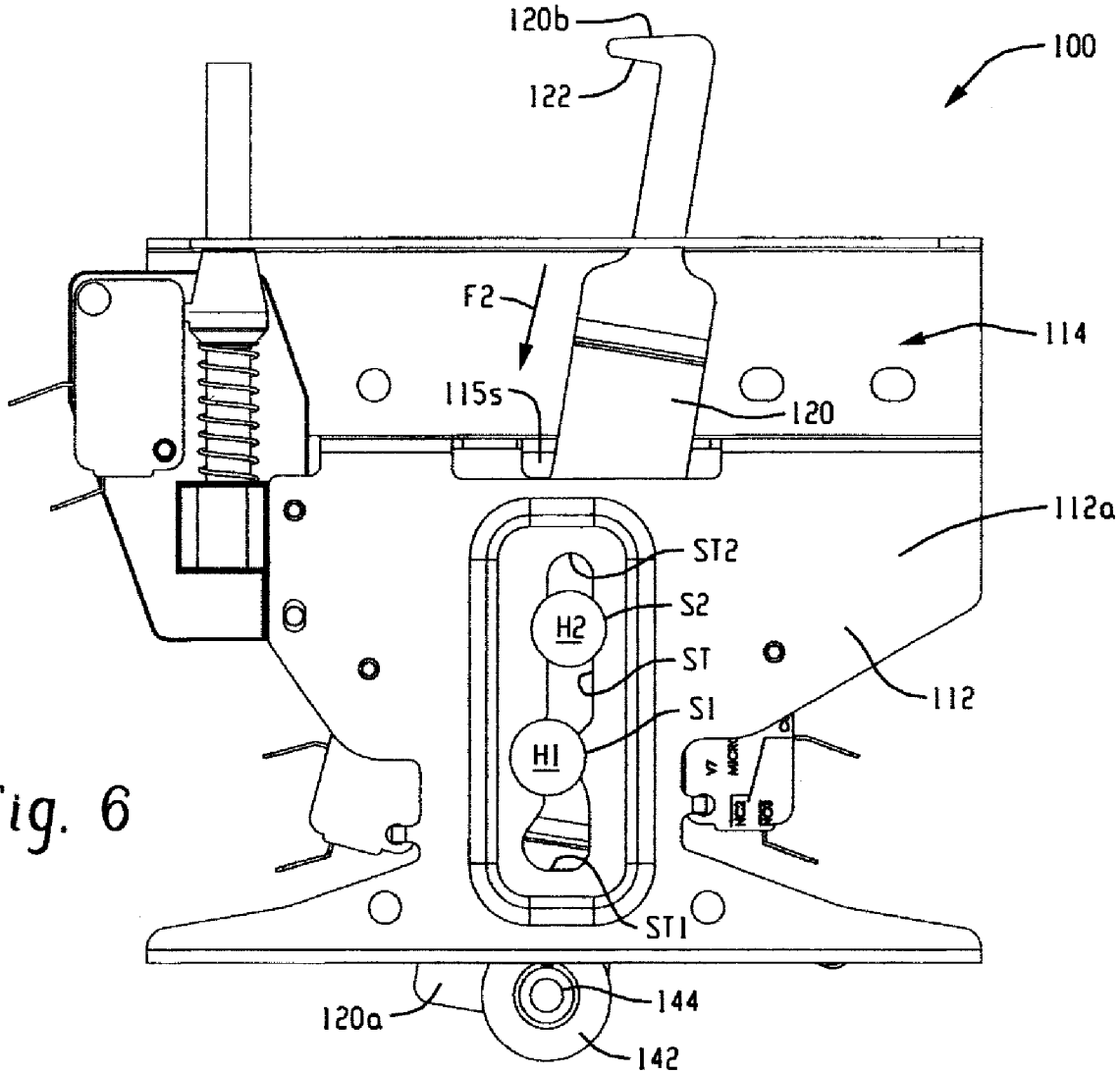
Figure 7A:
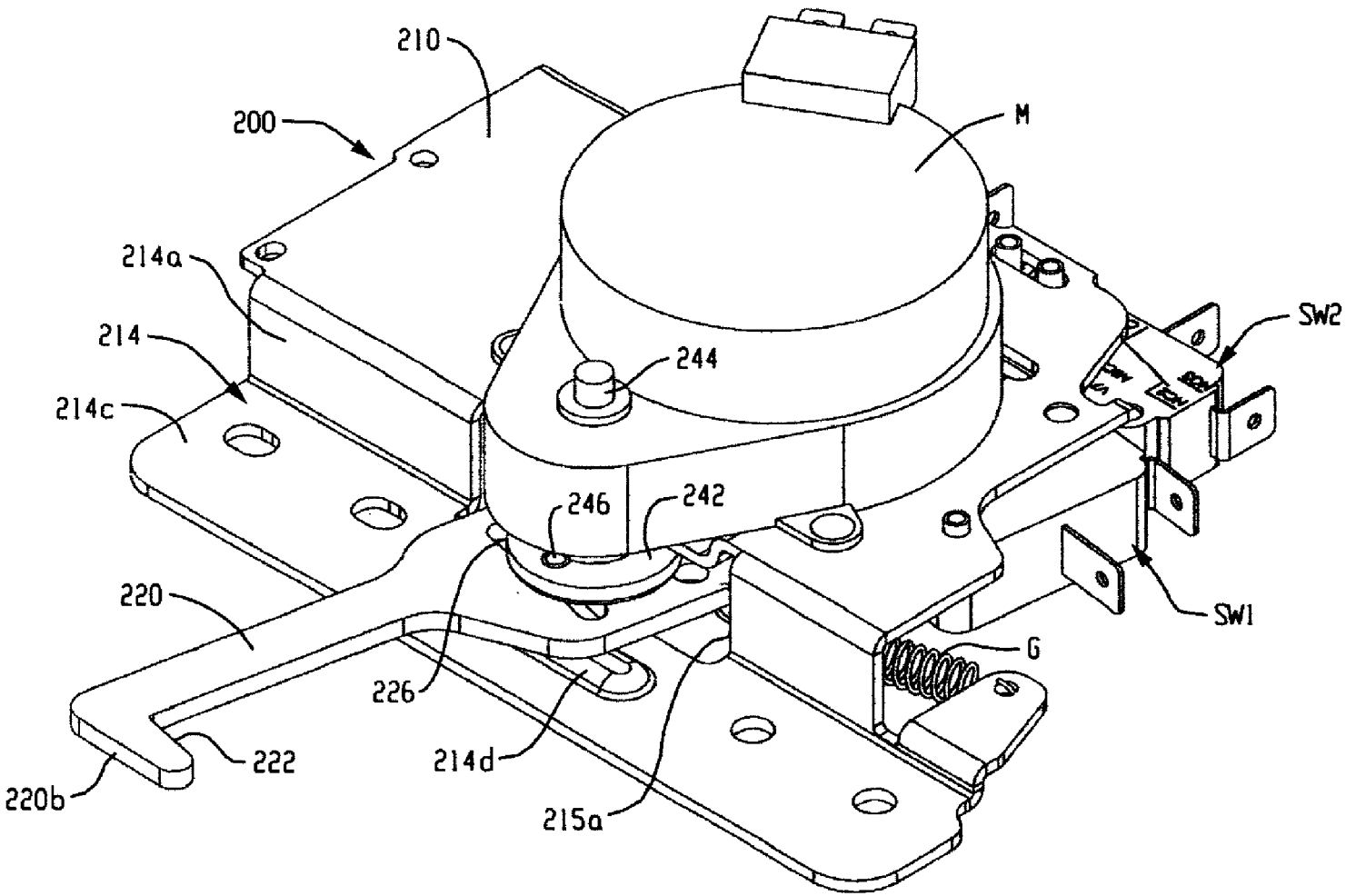
FIGS. 7A-7F (collectively FIG. 7) respectively show isometric, plan, front, bottom, right and left views of a second embodiment of a motorized oven door latch formed in accordance with the present invention in its unlocked configuration.
Figure 7B:
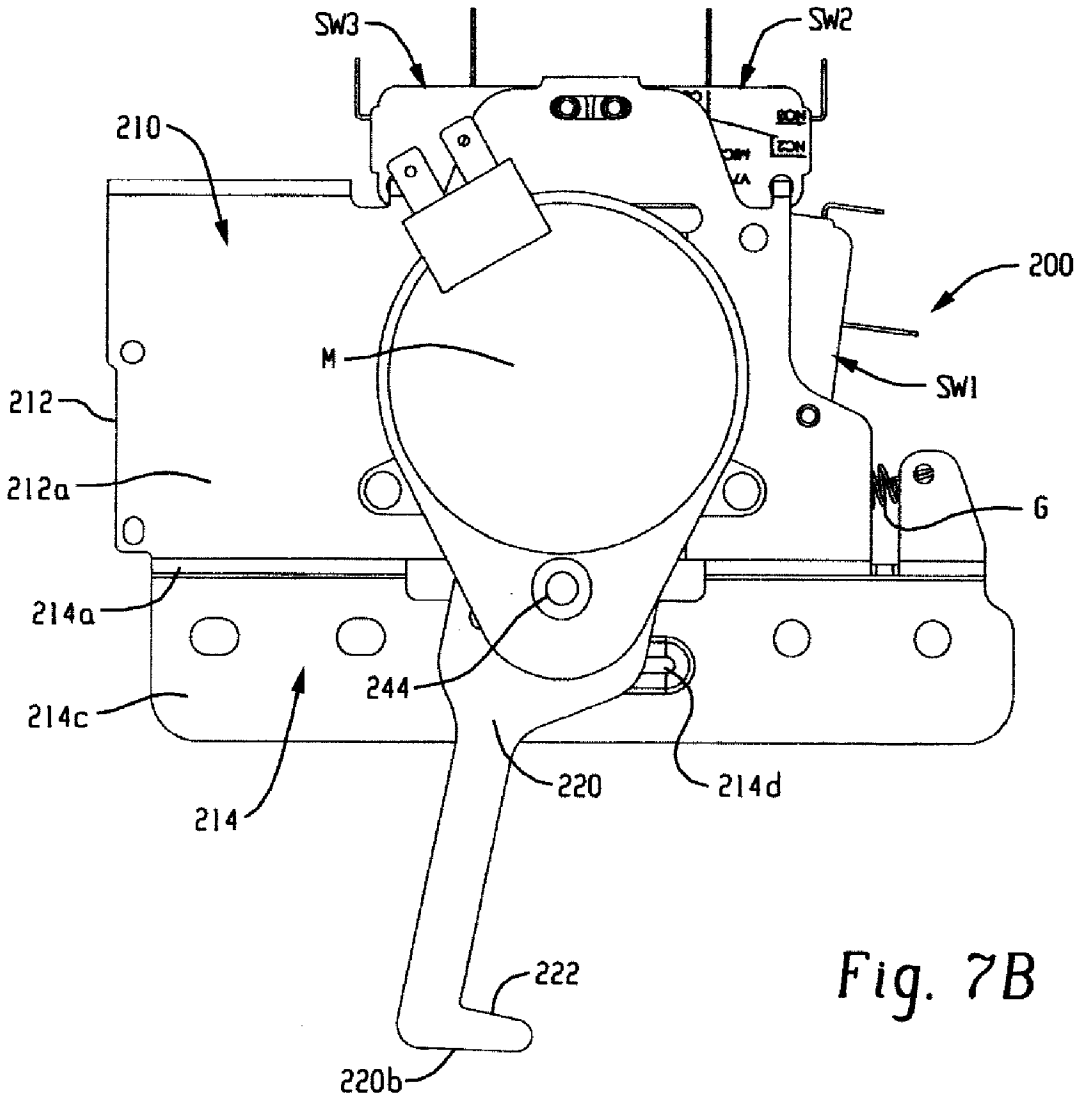
Figure 7C:
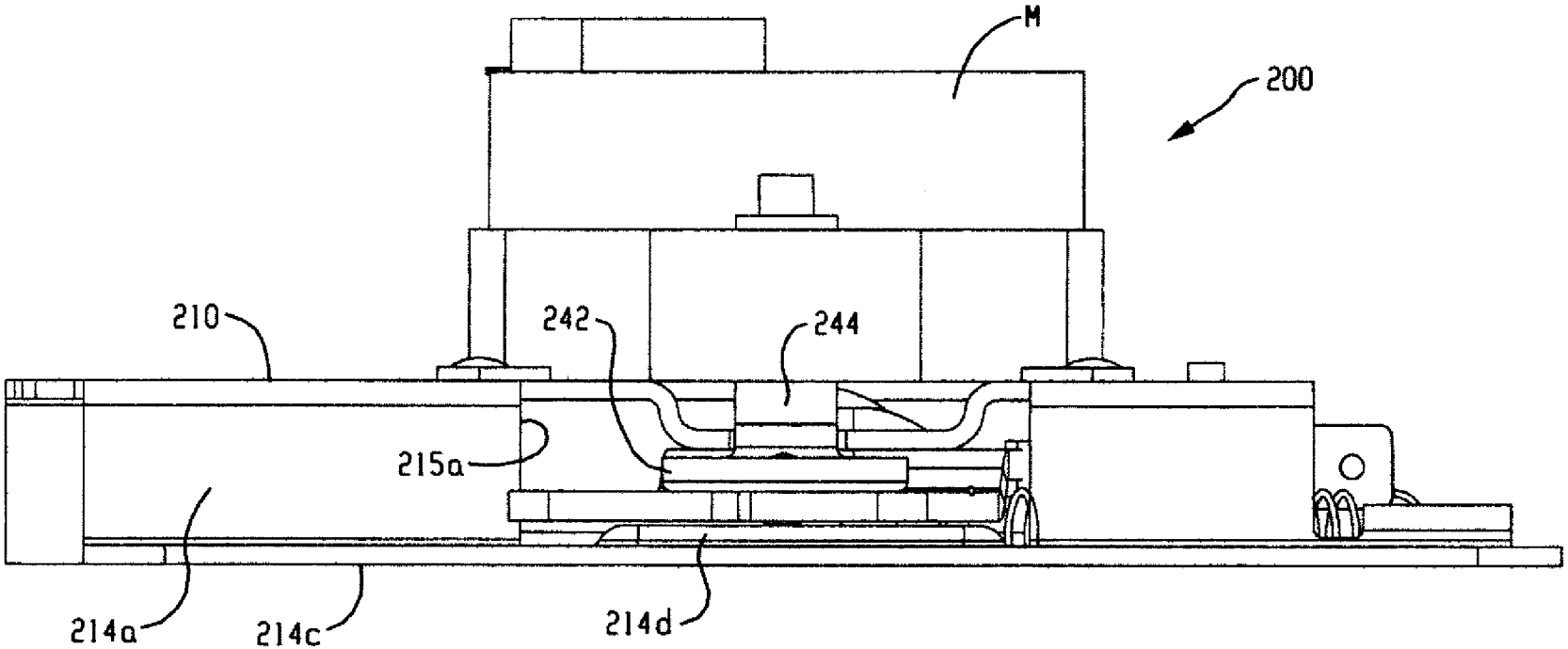
Figure 7D:
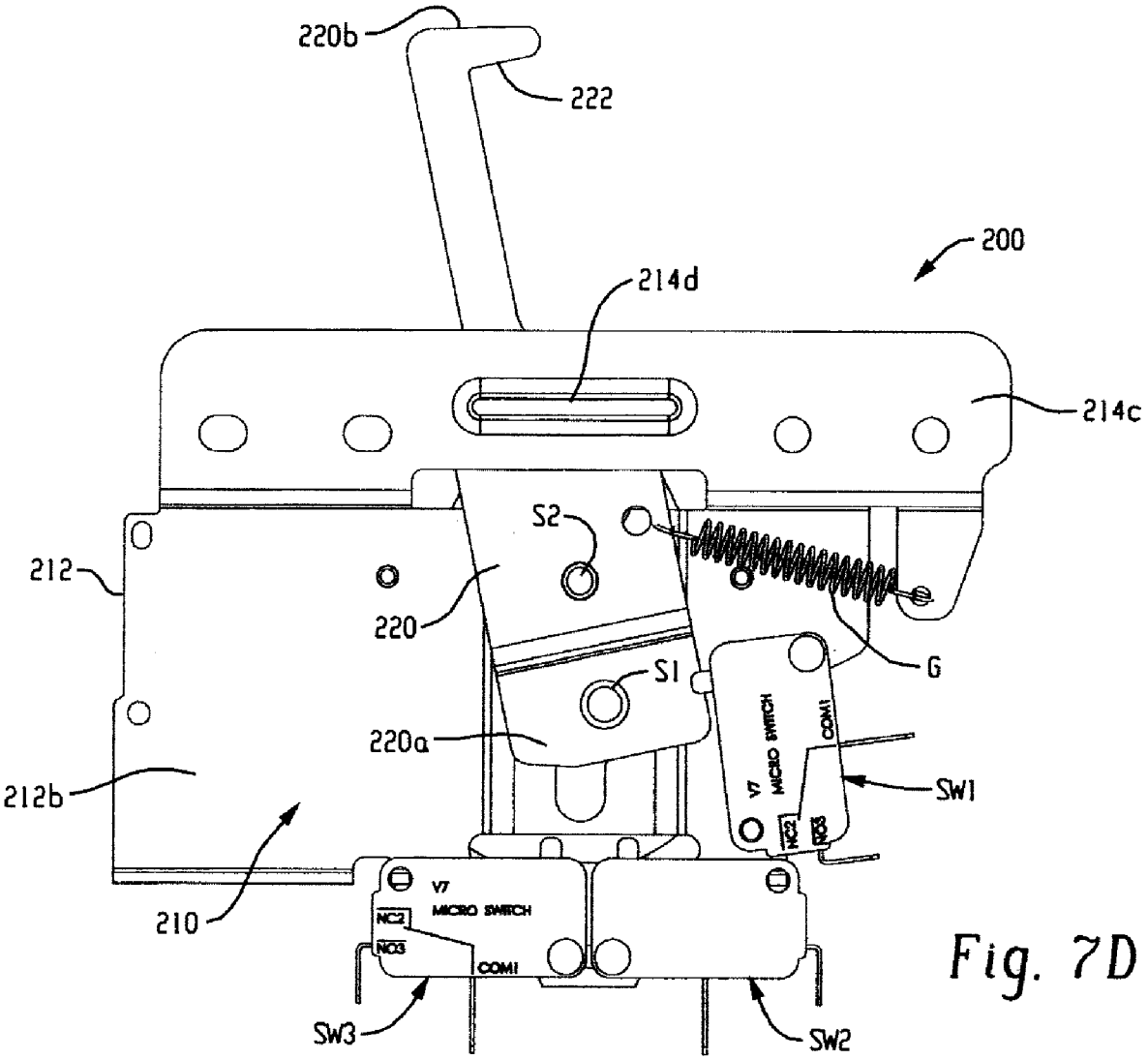
Figure 7E:
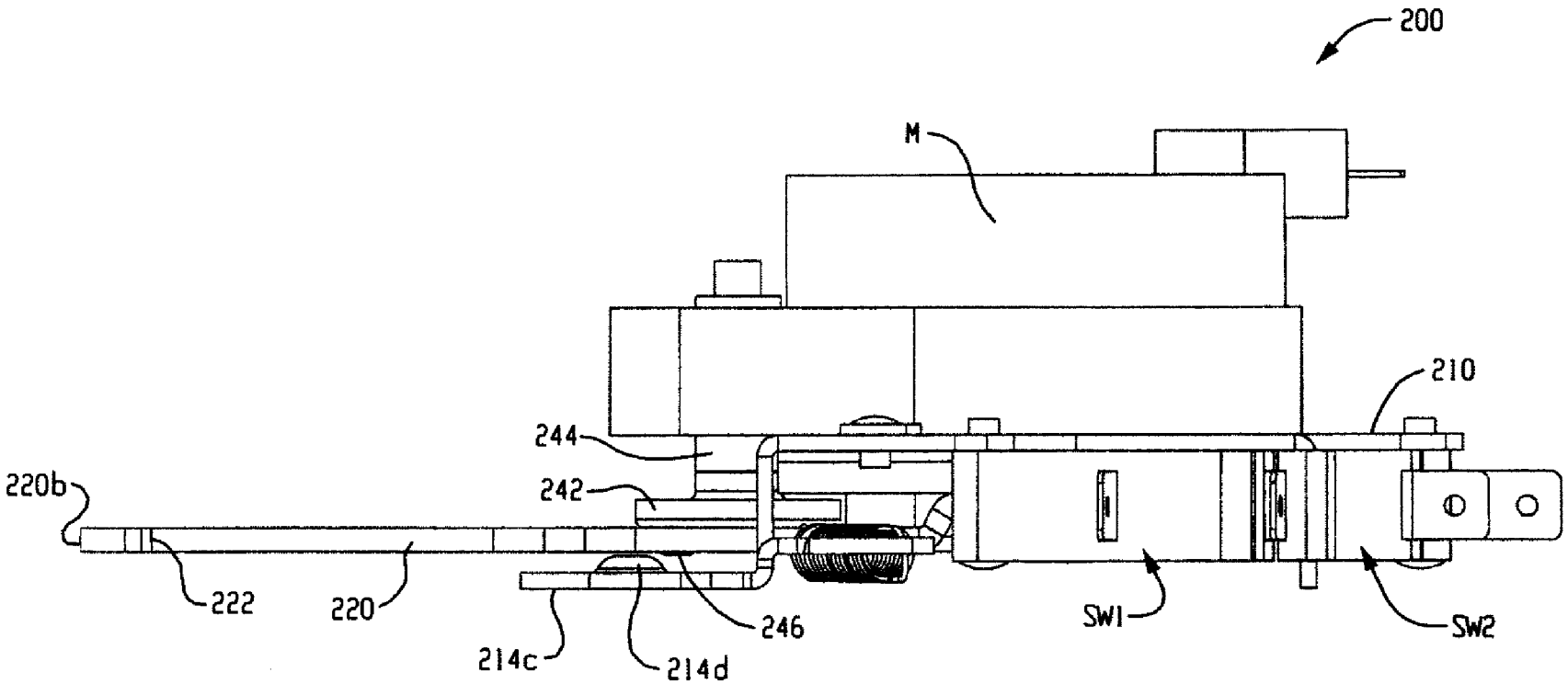
Figure 7F:
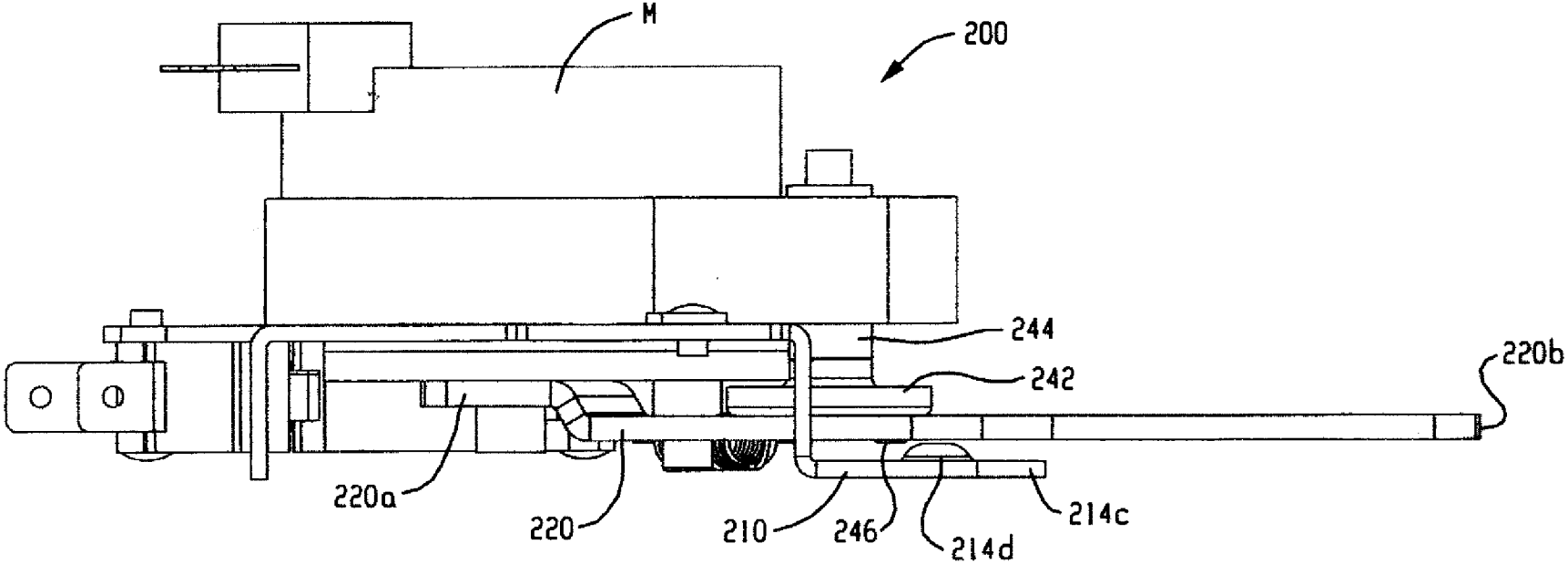
Figure 8A:
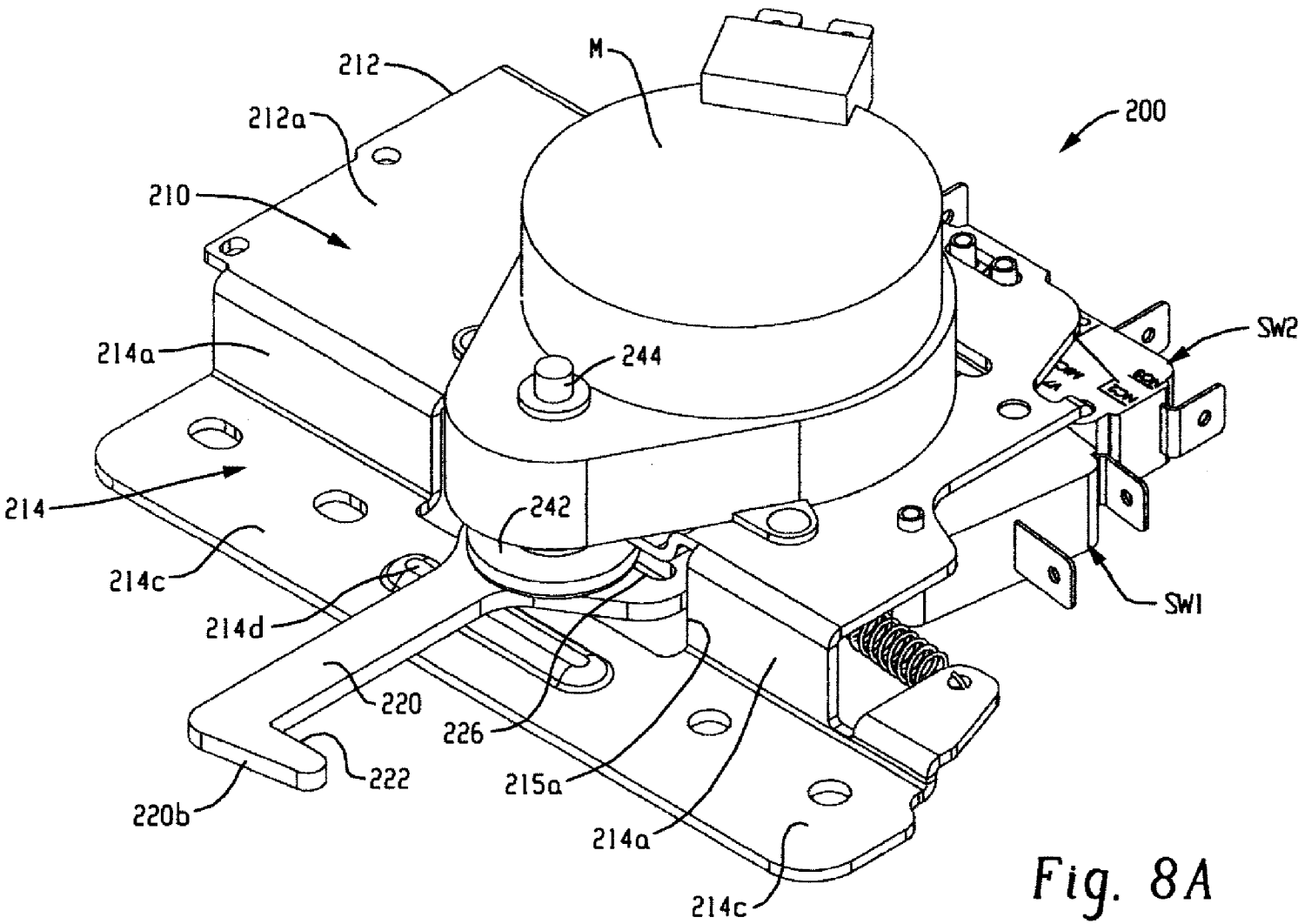
FIGS. 8A-8F (collectively FIG. 8) respectively show isometric, plan, front, bottom, right and left views of the second embodiment of FIGS. 7A-7F but show the oven door latch in its locked configuration.
Figure 8B:
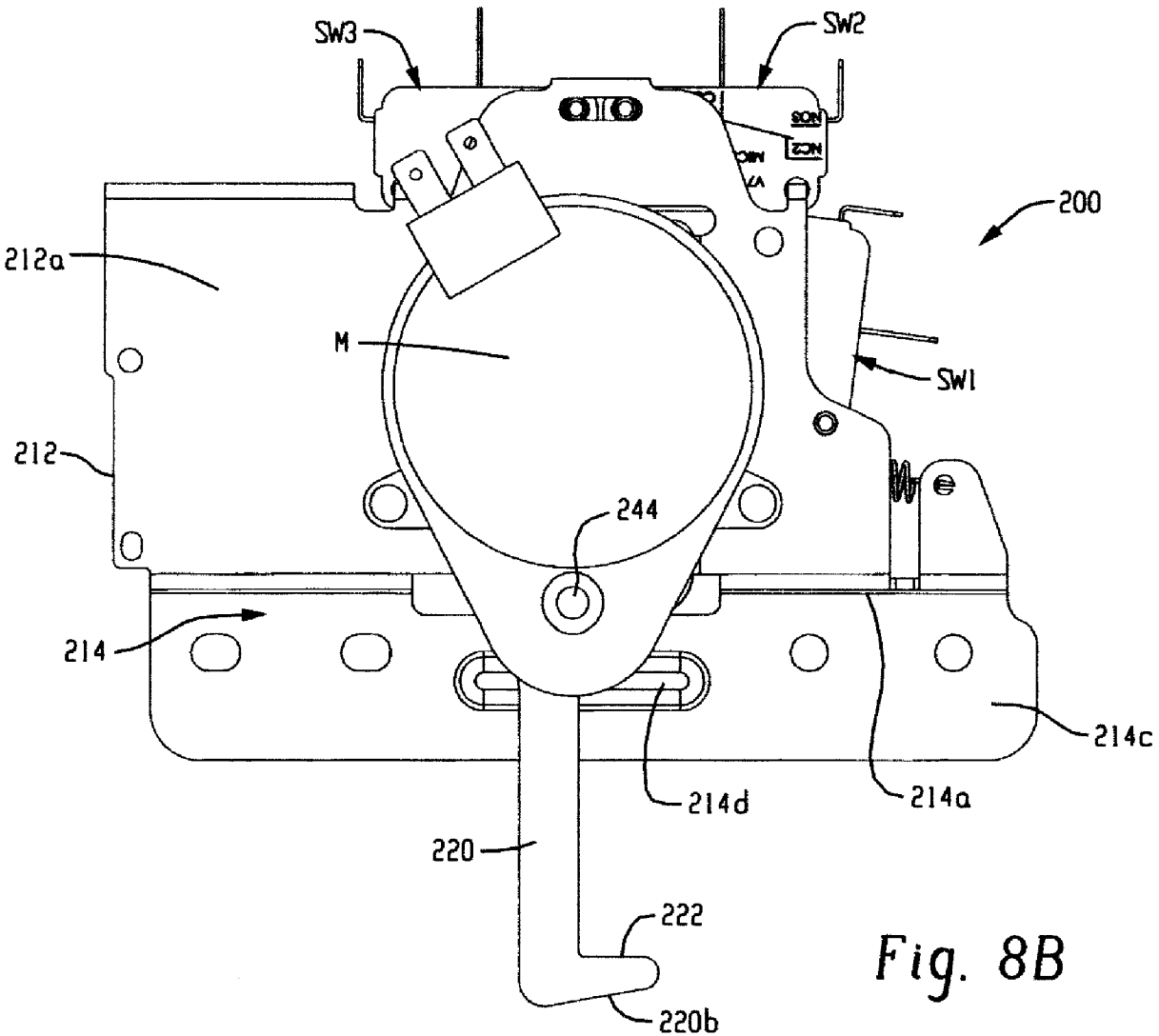
Figure 8C:
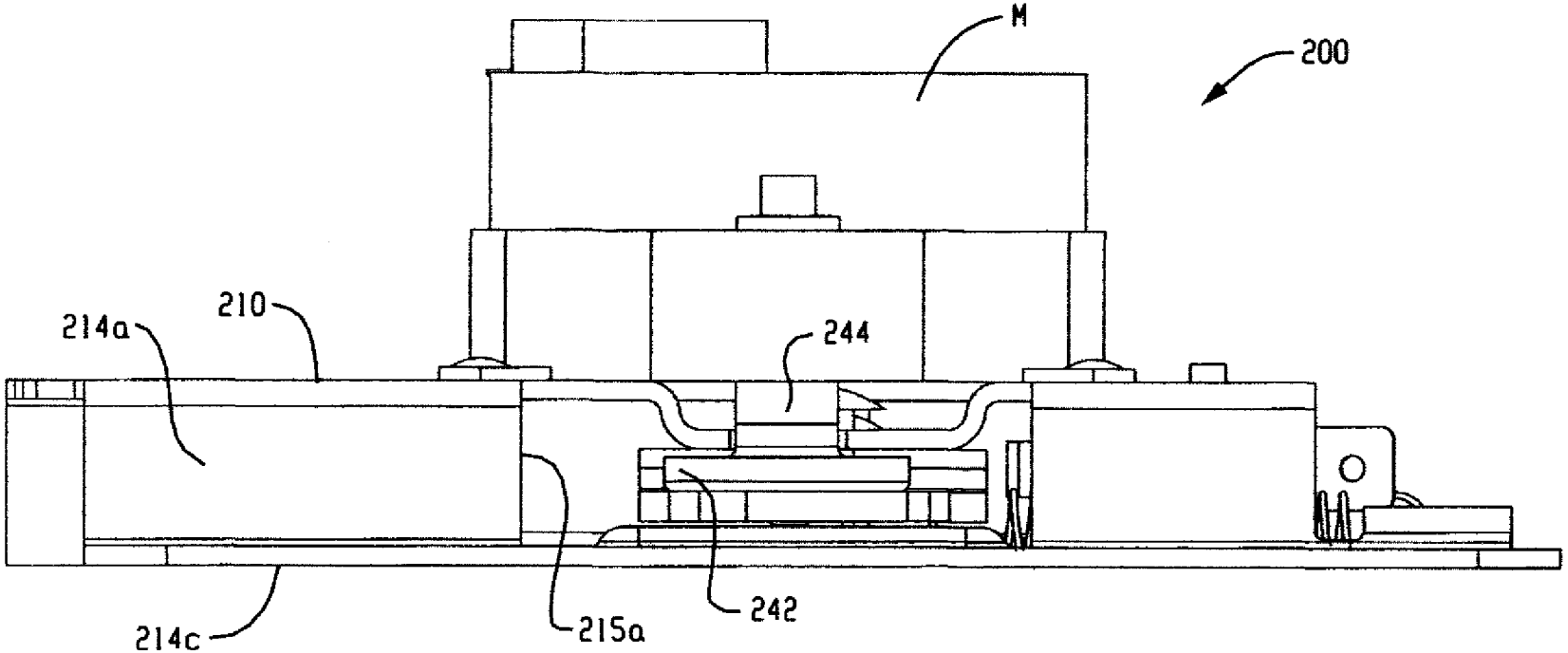
Figure 8D:
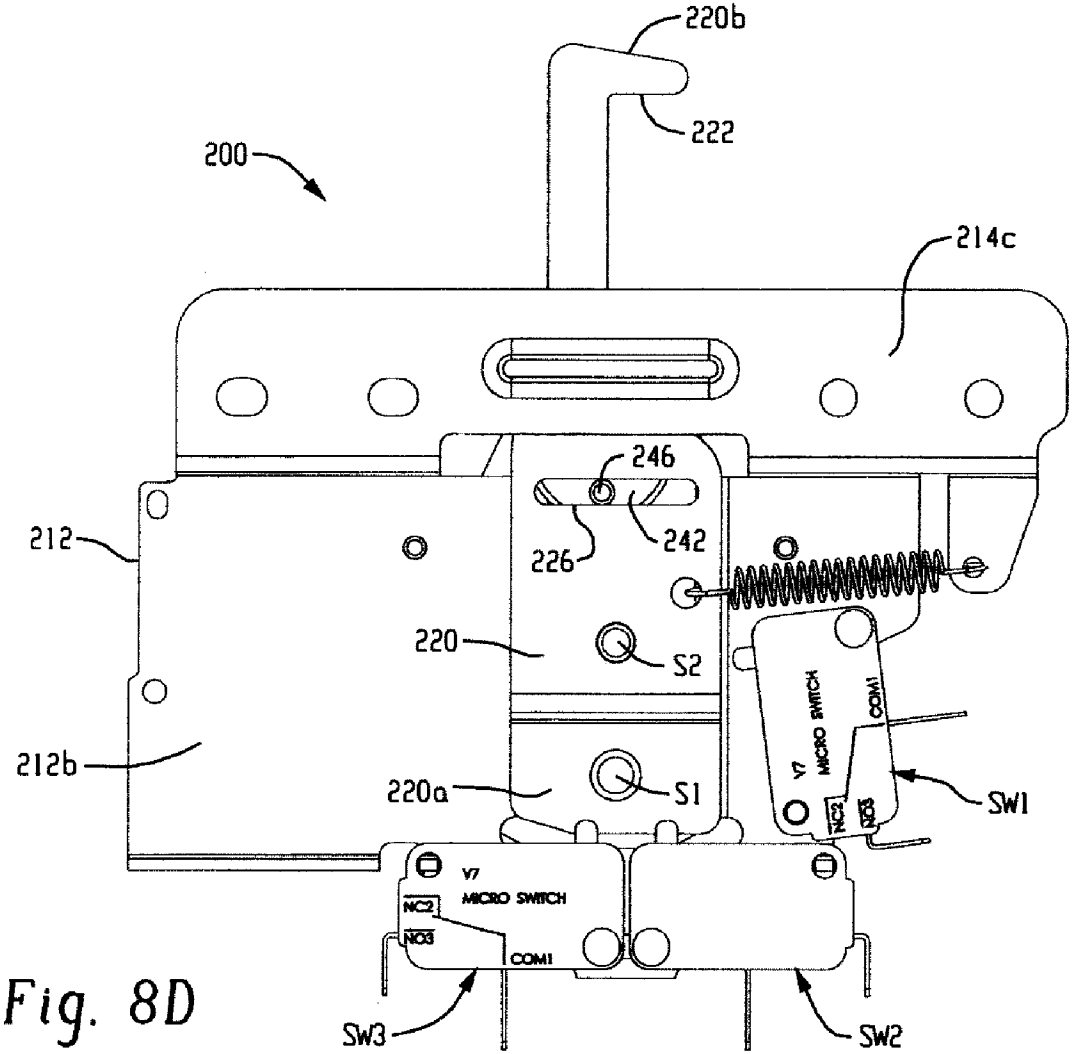
Figure 8E:
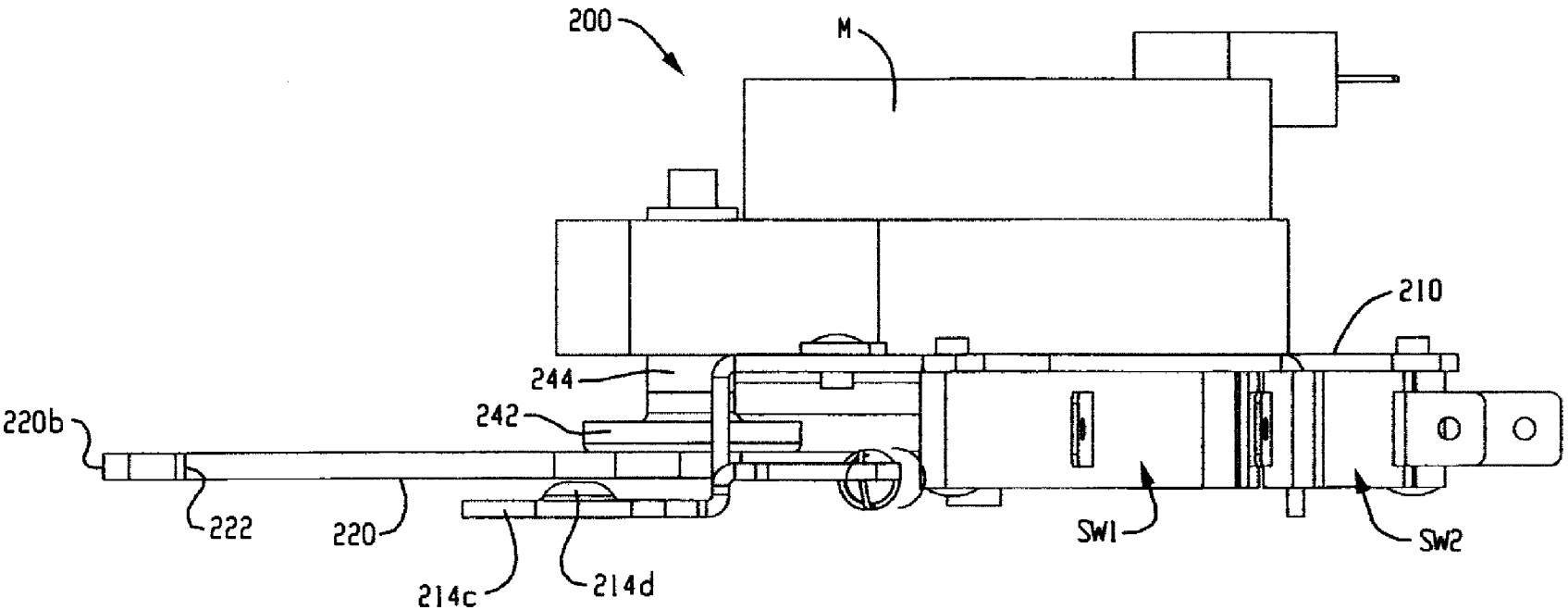
Figure 8F:
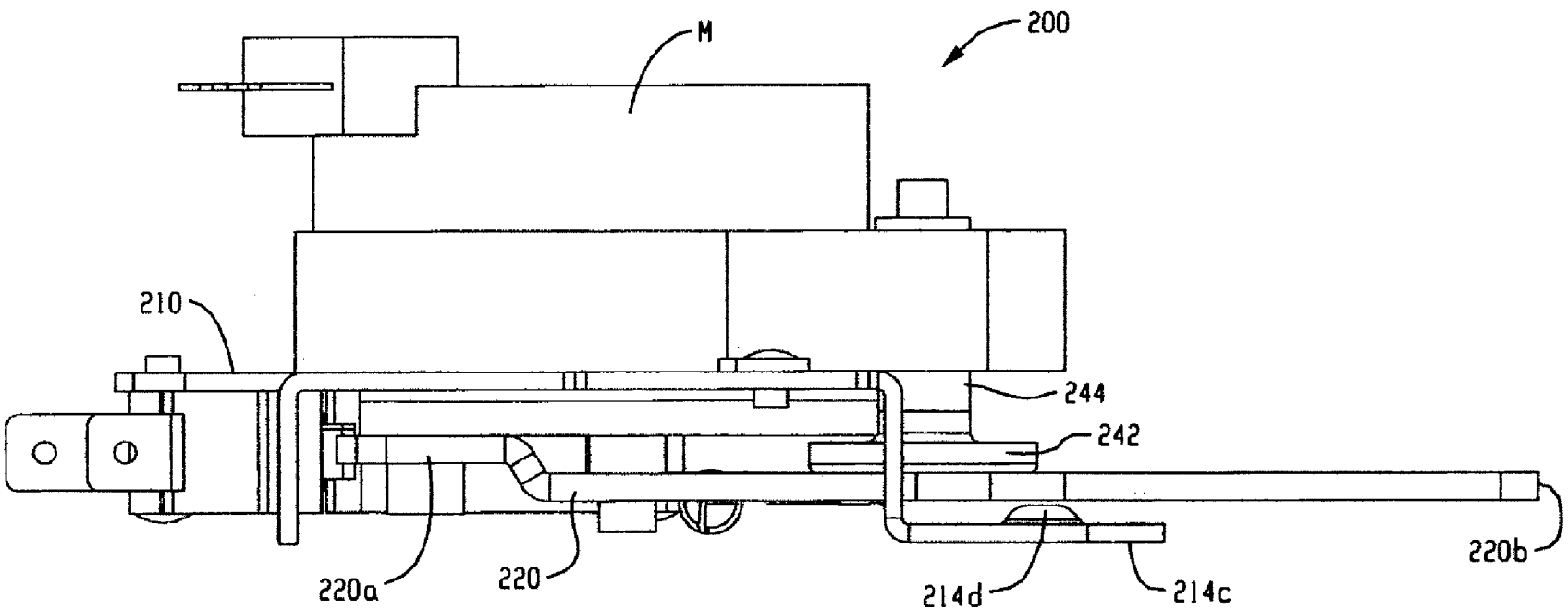

FIGS. 1-6 illustrate a motorized oven door latch 100 in accordance with a first embodiment of the present invention (in FIGS. 5 and 6 the motor M is removed to reveal the underlying components). The latch 100 comprises a mounting plate or base plate 110, preferably defined from a metal stamping or the like, so as to be conformed and dimensioned to be secured in a mounting location of an associated oven chassis (not shown) so that the latch 100 will be operably positioned for selective automatic locking and unlocking of the oven door as required for self-cleaning operations.

A latch member 120 is movably secured to the base plate 110 and is adapted for sliding movement to and from a locked position (FIGS. 1-5) and an unlocked position (FIG. 6). The latch member 120, also preferably defined from a metal stamping or the like, includes an inner end 120*a* (see FIG. 3) and an outer end 120*b*. As shown, the latch member 120 is one-piece, but it can be assembled from two or more components. The outer end includes a hook portion 122. When the latch member 120 is located in its locked position (FIGS. 1-5), the hook portion 122 is engaged with a mating receptacle or other structure of the oven door (not shown) to pull the oven door into a tightly closed position relative to the oven chassis and to prevent movement of the oven door from its closed position to its opened position. When the latch member 120 is located in its unlocked position (FIG. 6), the hook portion 122 thereof is disengaged from the oven door so that movement of the oven door between its opened and closed positions is uninhibited by the latch member 120 for normal cooking operations. As described in further detail below, an electric motor M is mounted in the base plate 110 and is operably coupled with the latch member 120 and drives the latch member between its locked and unlocked positions.

The latch member 120 is movably secured to the base plate 110. In particular, the base plate comprises a central portion 112 having upper and lower surfaces 112*a*,112*b*. For reasons of fit and mounting, the base plate 110 also optionally includes or defines a transverse channel 114 adjacent and forward of the central portion 112. In the illustrated embodiment, the channel is defined by a first vertical wall 114*a* connected to the central portion 112 and a second (front)

vertical wall 114*b* parallel to and spaced apart from the first vertical wall 114*a*. The first and second walls 114*a*,114*b* are connected by a base wall 114*c*. The walls 114*a*,114*b* define respective windows 115*a*,115*b* through which the latch member 120 extends so that the outer end 120*b* of the latch member projects outwardly from the wall 114*b*. Depending upon the particular application, the latch member 120 can rest on and be supported by the base wall 114*c* and/or the base wall 114*c* can optionally comprises a separate or integral slide member (e.g., a boss) on which the latch member 120 is supported to facilitate sliding movement of the latch member. In the illustrated embodiment, part of the wall 114*a* defining the lower edge of the window 115*a* defines a support 115*s* on which the latch 120 is slidably supported. As shown, the support 115*s* comprises a bent tab portion of the wall 114*a* that provides an increased surface area for supporting the latch 120 as compared to a support defined only by the thickness of the wall 114*a*. As noted, the channel 114 is optional and not required or desired for certain applications and/or oven mounting environments.

More particularly, the latch member 120 is movably secured to the base plate 110 by at least one and preferably first and second mounting studs S1,S2 which, in the illustrated embodiment, are rivets but other stud-like fasteners can be used. As shown in FIGS. 5 and 6 (where the motor M has been removed from the base plate 110 to reveal the underlying structure), it can be seen that the central region 112 of the base plate 110 comprises a contoured slot ST defined therein. The latch member 120 lies beneath and adjacent the underside 112*b* of the base plate central region 112. The shank portions of the first and second mounting studs S1,S2 extend through the slot ST and are immovably secured in the latch member 120 (see also FIG. 3) with a press-fit or by deformation of the shank (such as a rivet) or by a nut or cap or other device mated with the shank of each mounting stud S1,S2. The enlarged heads H1,H2 of the respective studs S1,S2 cannot pass through the slot ST and are thus captured adjacent the upper surface 112*a* of the base plate central region 112. The base plate 110 is thus captured between the latch member 120 and the enlarged heads H1,H2 of the mounting stud S1,S2. The studs S1,S2 secure the latch member 120 to the base plate 110 with sufficient but minimal clearance to allow sliding movement of the latch member 120 relative to the base plate 110 in a plane that lies parallel to the base plate central region 112 with the movement of the latch member 120 being defined and controlled by corresponding movement of the studs S1,S2 in the slot ST according to the contours of the slot.

With specific reference again to FIGS. 5 and 6, those of ordinary skill in the art will recognize that a first force F1 (FIG. 5) exerted on the latch member 120 in a first or forward or "unlocking" direction, i.e., in a direction oriented generally away from an inner end or region ST1 of slot ST and/or toward an outer end or region ST2 of slot, will move the latch member 120 from its locked position of FIG. 5 to its unlocked position of FIG. 6 owing to the movement of the studs S1,S2 in the contoured slot ST along a non-linear path that follows the shape of the slot ST. Likewise, a second force F2 (FIG. 6) exerted on the latch member 120 in a second or rearward or "locking" direction generally opposite the unlocking direction will move the latch member from its unlocked position of FIG. 6 to its locked position of FIG. 5 due to the reverse movement of the studs S1,S2 along the non-linear path following the contoured slot ST in an opposite direction relative to the movement of the studs in the unlocking direction.

In the event of a malfunction of the motor M or other malfunction when the latch member 120 is in its locked position as shown in FIG. 5, it is necessary to provide a way for a service technician to release the latch 120 to allow the oven door to be opened. For this reason, the innermost end or region ST1 of the slot ST is enlarged sufficiently to accommodate angular movement of outer end 120*b* of latch member (indicated by arrow A1) and resulting angular movement of the inner stud S1 (indicated by arrow A2) pivotally about the stud S2 when the latch member 120 is in its locked position and a tool is used to apply a lateral force F3 to the outer end 120*b* of the latch member to move the latch member to a manual unlock position. This permitted manual angular movement of the outer end 120*b* of the latch member is sufficient to disengage the outer hook portion 122 of the latch member 120 from the associated oven door to permit opening of the door. A spring G (FIGS. 2-4) is connected between the base 110 and the latch member 120 and normally biases the latch member 120 away from the manual unlock position when the latch member is in its locked position as shown in FIG. 5, but the biasing force of the spring G can be overcome by the manual force F3 to allow for selective movement of the latch member 120 to the manual unlock position as just described. In the illustrated embodiment, the spring G is operatively connected between the inner end 120*a* of the latch member and a rear vertical wall 116 of the base plate 110. It should be noted that the rear vertical wall 116 includes a recess or window 116*a* that accommodates passage of the latch member 120.

Figure 1:
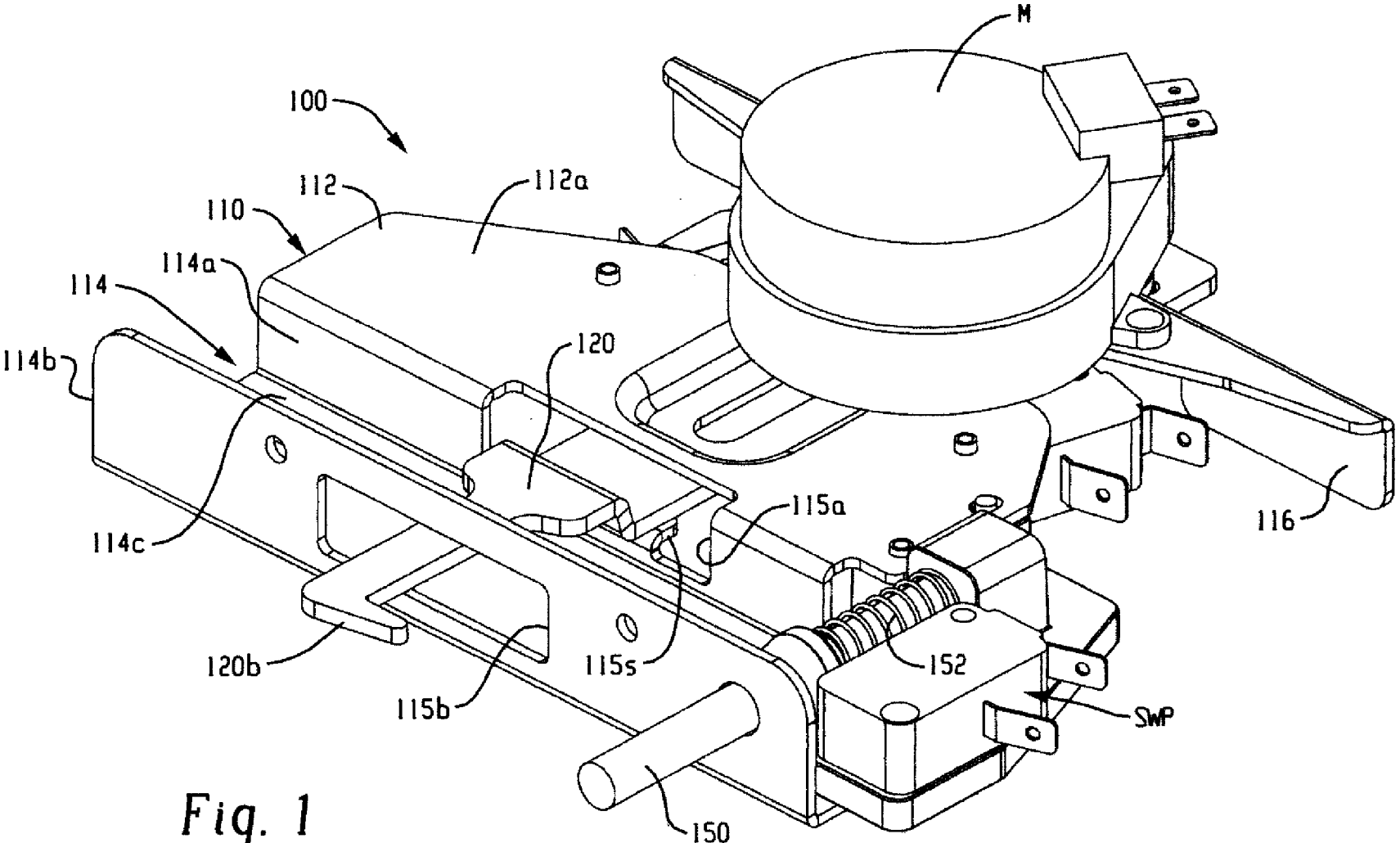
FIGS. 1-6 illustrate a motorized oven door latch in accordance with a first embodiment of the present invention, with FIGS. 1-3 being isometric views, FIG. 4 being a bottom view, and FIGS. 5 and 6 providing locked and unlocked plan views with the motor removed to reveal the underlying components.
Figure 2:
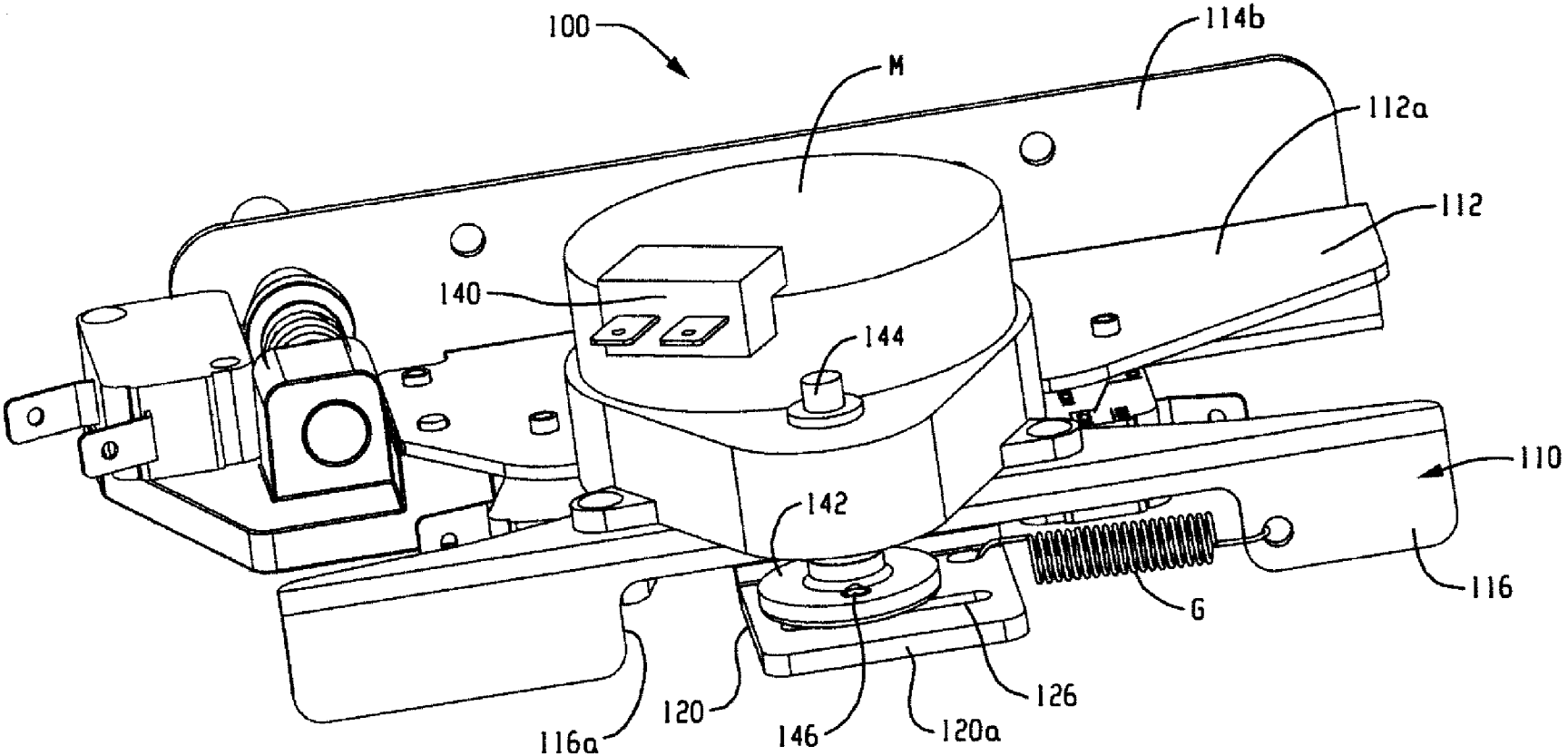

With particular reference to FIGS. 2 and 3, the latch member 120 is driven to and between its locked and unlocked positions by the electric motor M which is secured to the base plate 110 and operably coupled to the inner end 120*a* of the latch member 120. The motor is selectively operative to move the latch member 120 forward and rearward relative to the base plate 110 between the locked position and the unlocked position, wherein the latch member 120 moves angularly or otherwise non-linearly relative to the base plate 110 in response to movement of the first and second mounting studs S1,S1 in the contoured slot ST when the motor M moves the latch member 120 forward to the unlocked position or rearward to the locked position. The motor includes an electrical input 140 for input of supply voltage from the oven electrical system. The motor M further includes an output link such as an output wheel 142 or other member that is connected to and rotated about a drive shaft 144 that is driven by the motor M and that overhangs rear wall 116 in the region of its window 116*a*. A drive pin 146 is connected to and projects outwardly from the output wheel 142 and moves concentrically about the drive shaft 144 when the output wheel 142 rotates. The inner end 120*a* of the latch member 120 includes an elongated drive slot 126 that extends transversely relative to the longitudinal axis of the latch member 120, i.e. transverse relative to a the axis that extends between the inner and outer ends 120*a*,120*b* of the latch member. The drive pin 146 of output wheel 142 is located in the drive slot 126. When the motor M is energized to rotate the drive shaft 144 and output wheel 142, rotational movement of the drive pin 146 about the drive shaft 144 reciprocates the latch member 120 due to the engagement of the drive pin 146 in the drive slot 126, and the elongated shape of the drive slot 126 and the sliding fit of the drive pin 146 therein accommodates non-linear movement of the latch 120 as the studs S1,S2 follow the contours of the slot ST. The window 116*a* in the rear vertical wall 116 allows for location and rotation of the output wheel 142 and engagement of the drive pin 146 with the latch member drive slot 126. Furthermore, the elongated drive slot 126 allows the latch member 120 to be moved manually from its locked position to the manual unlocked position by the force F3 as described above in the event of a malfunction even though the motor output wheel 142 does not rotate.

FIG. 4 shows that the motorized oven door latch 100 further comprises first and second switches SW1,SW2 that are opened/closed or otherwise operated by contact with latch member 120 to provide electrical input to the control system of the associated oven that indicates the position of the latch member 120 to ensure that the latch member 120 is in the locked position before the self-cleaning cycle of the oven can begin. In the illustrated example, both switches SW1,SW2 are mounted to the underside 112*b* of the central portion 112 of the base plate 110. The latch member 120 includes one or more lobes such as the lobe 128 that is positioned to engage the switch SW1 when the latch member 120 is in its locked position as shown in FIG. 4. The arrangement of switches SW1,SW2 shown herein is only one example of a suitable arrangement and it is not intended that the present invention be limited to any particular arrangement of switches.

The motorized oven door latch 100 can include an optional plunger switch SWP (FIG. 1) that includes a plunger 150 that is biased to an extended position by a spring 152 and that is engaged and depressed by contact with the associated oven door when the oven door is closed or partially closed to control other features of the oven such as lights, safety features or the like. The plunger switch SUVP is connected to the base plate 110, e.g., mounted to the base plate central portion 112 by rivets or other fasteners as shown herein.

FIGS. 7 and 8 (each including six views labeled A-F, respectively) illustrate a second embodiment of a motorized oven door latch 200 formed in accordance with the present invention, in unlocked and locked configurations, respectively. Unless otherwise shown and/or described, the structure and operation of the motorized oven door latch 200 correspond to the motorized oven door latch 100 just described, and like reference signs are used in FIGS. 7 and 8 as compared to FIGS. 1-6 to indicate the same or similar components, except that the reference numbers have been increased by 100 so as to be 200 series numbers.

The base plate 210 is formed so that the channel 214 is only two sided, including the side wall 214*a* connected to the base plate central portion 212 and the base wall 214*c*. Another main distinction of the motorized oven door latch 200 relative to the motorized oven door latch 100 is that the motor M is rotated 180 degrees on the base plate 210 so that the output drive shaft 244 overhangs the inner wall 214*a* of channel 214 in the region of the window 215*a* of channel side wall 214*a*. The transverse elongated drive slot 226 of the latch member 220 is correspondingly relocated to a central portion of the latch member 220 so as to be positioned for engagement by the drive pin 246 of motor output wheel 242 so that rotation of the output wheel 242 moves the drive pin 246 concentrically about the drive shaft 244 which causes sliding movement of the latch member 220 between its unlocked (FIG. 7) and locked (FIG. 8) positions.

The illustrated motorized oven door latch 200 does not include a plunger switch for being operated by the oven door. Instead, it includes three switches SW1,SW2,SW3 secured to the base plate 210 that are activated (e.g., opened/closed) by the latch member 220 as it moves to and between its unlocked (FIG. 7) and locked (FIG. 8) positions.

Figure 9:
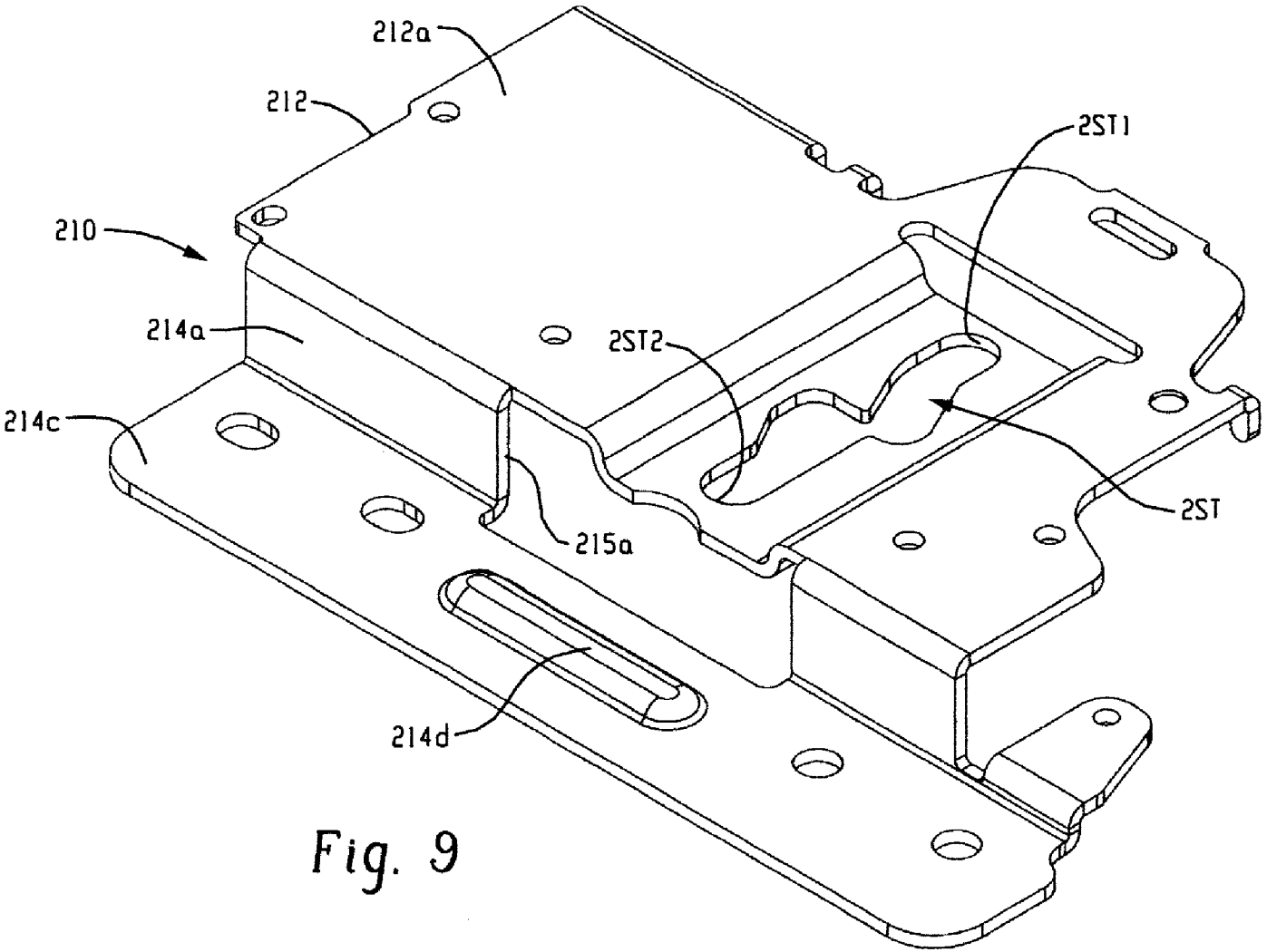
FIG. 9 shows the mounting plate or base plate portion of the embodiment of FIGS. 7 and 8, FIGS. 10 and 11 show the motorized oven door latch of FIGS. 7 and 8 in unlocked and locked positions, respectively, with the motor removed to reveal underlying components.

With reference a so to FIG. 9, where the base plate 210 is shown alone, the motorized oven door latch 200 includes a base plate 210 having a guide slot 2ST that is similar to the guide slot ST of the motorized oven door latch 100 but that is shaped differently as required to achieve the desired movement of the latch member 220. The inner and outer mounting studs S1,S2 (e.g., rivets) moveably secure the latch member 220 to the base plate 210 adjacent the underside 212*b* of the central region 212 (as disclosed above for the latch member 120 and slot ST) and slide in the guide slot 2ST between the inner and outer slot ends or regions 2ST1,2ST2 to control the position and orientation of the latch member 220 as it is moved inward and outward by the motor M.

Figure 10:
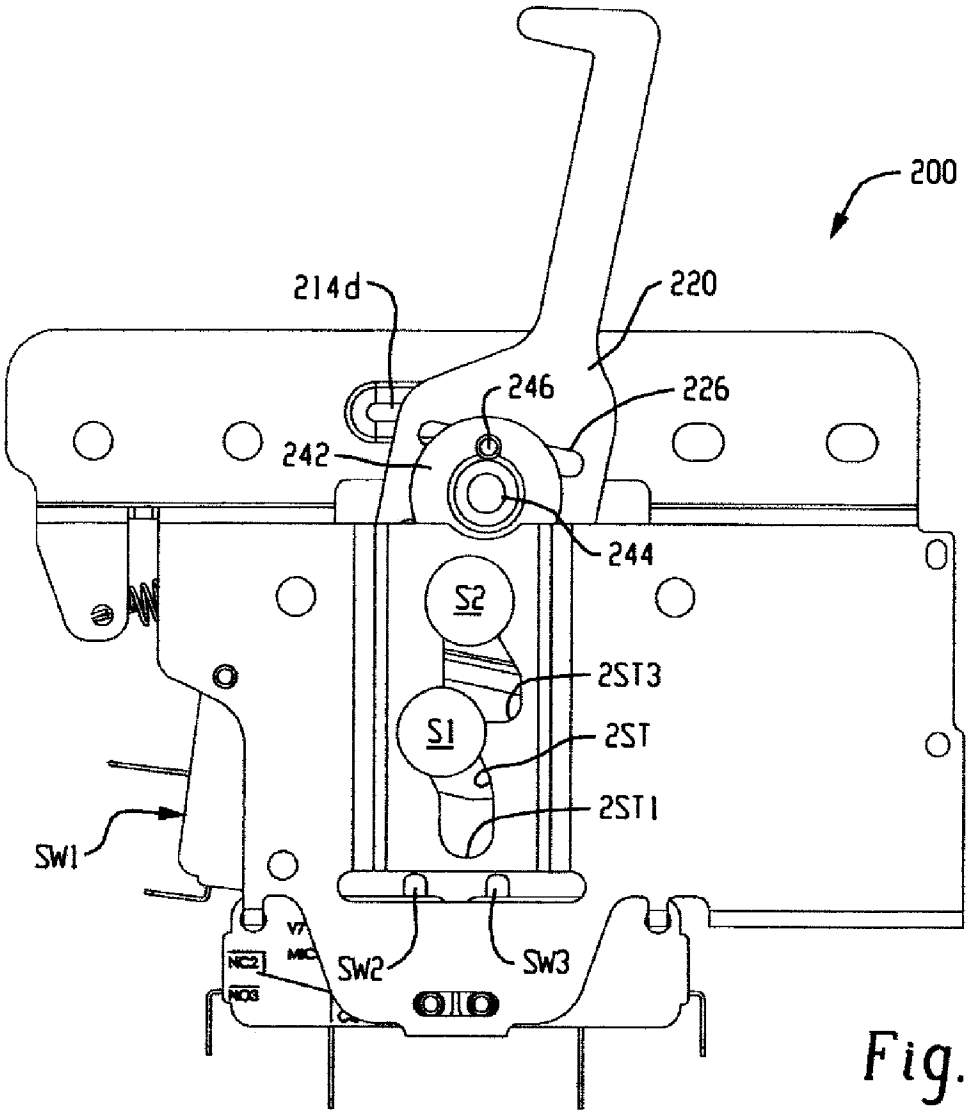
Figure 11:
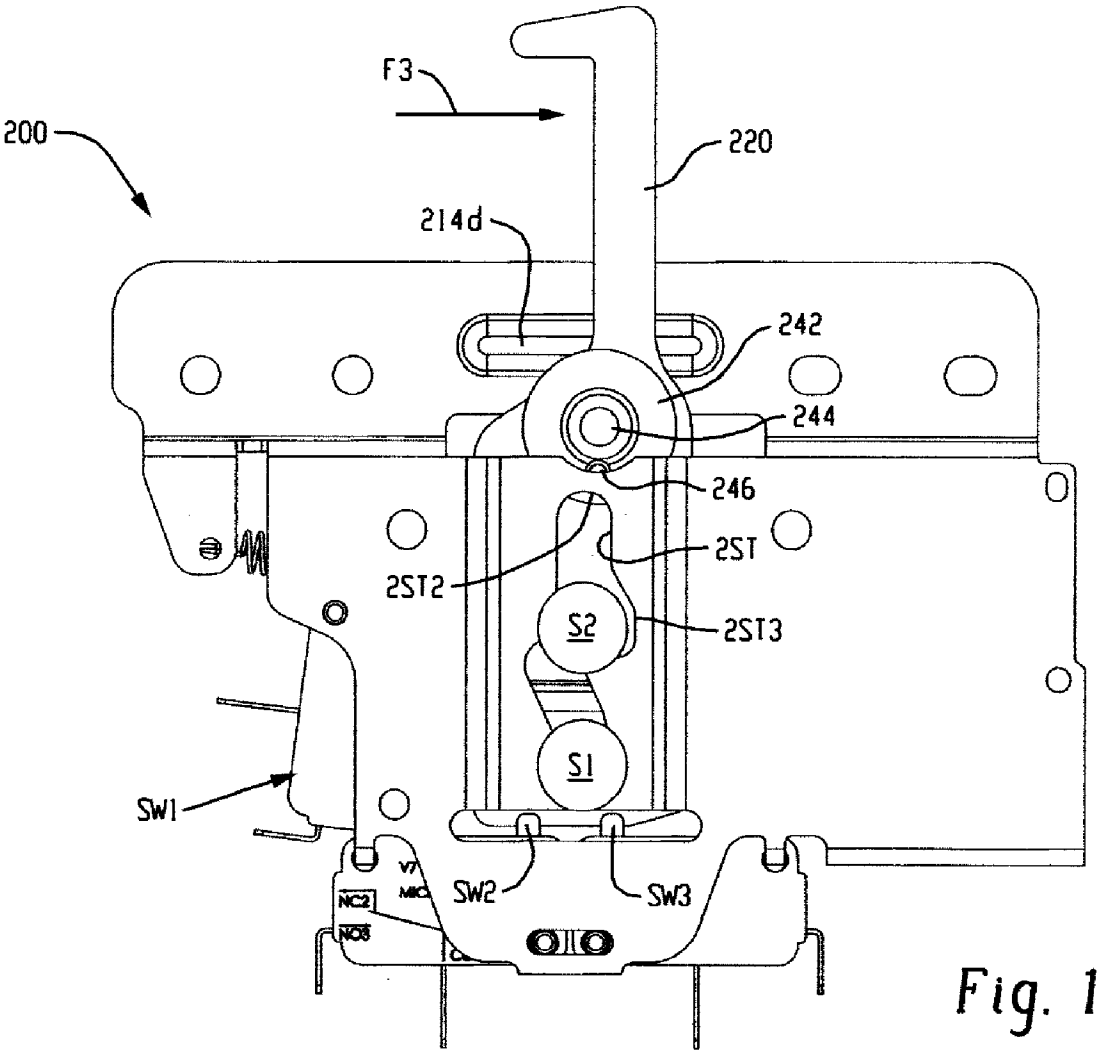

FIGS. 10 and 11 show the motorized oven door latch of FIGS. 7 and 8 in unlocked and locked positions, respectively, with the motor removed to reveal underlying components. The guide slot 2ST of the base plate 210 is shaped to so that when the latch member 220 is in its locked position (FIG. 11), the mounting stud S2 is located in an enlarged central region 2ST3 between the inner and outer ends 2ST1,2ST2. A manual lateral force F3 exerted on the latch member 220 when it is in its locked position (FIG. 11) will move the latch member to a manual unlock position due to the ability of the outer mounting stud S2 to shift position in the enlarged central region 2ST3 of the guide slot 2ST. A spring G (FIGS. 7D,8D) is connected between the base plate 210 and the latch member 220 and normally biases the latch member 220 away from the manual unlock position when the latch member is in its locked position as shown in FIG. 11, but the biasing force of the spring G can be overcome by the manual force F3 to allow for selective movement of the latch member 220 to the manual unlock position as just described. FIG. 11 shows the positions of the inner and outer mounting studs S1,S2 in the guide slot 2ST when the latch member 220 is moved to the locked position.

In FIGS. 7-9 it can be seen that the base wall 214*c* of the channel 214 includes a raised boss 214*d* that slidably supports the latch member 220 as it moves to and between its locked and unlocked positions. The boss 214*d* prevents undesired vertical sagging of the of latch member 220 as could lead to binding of movement of mounting studs S1,S2 in the guide slot 2ST.

Figure 12A:
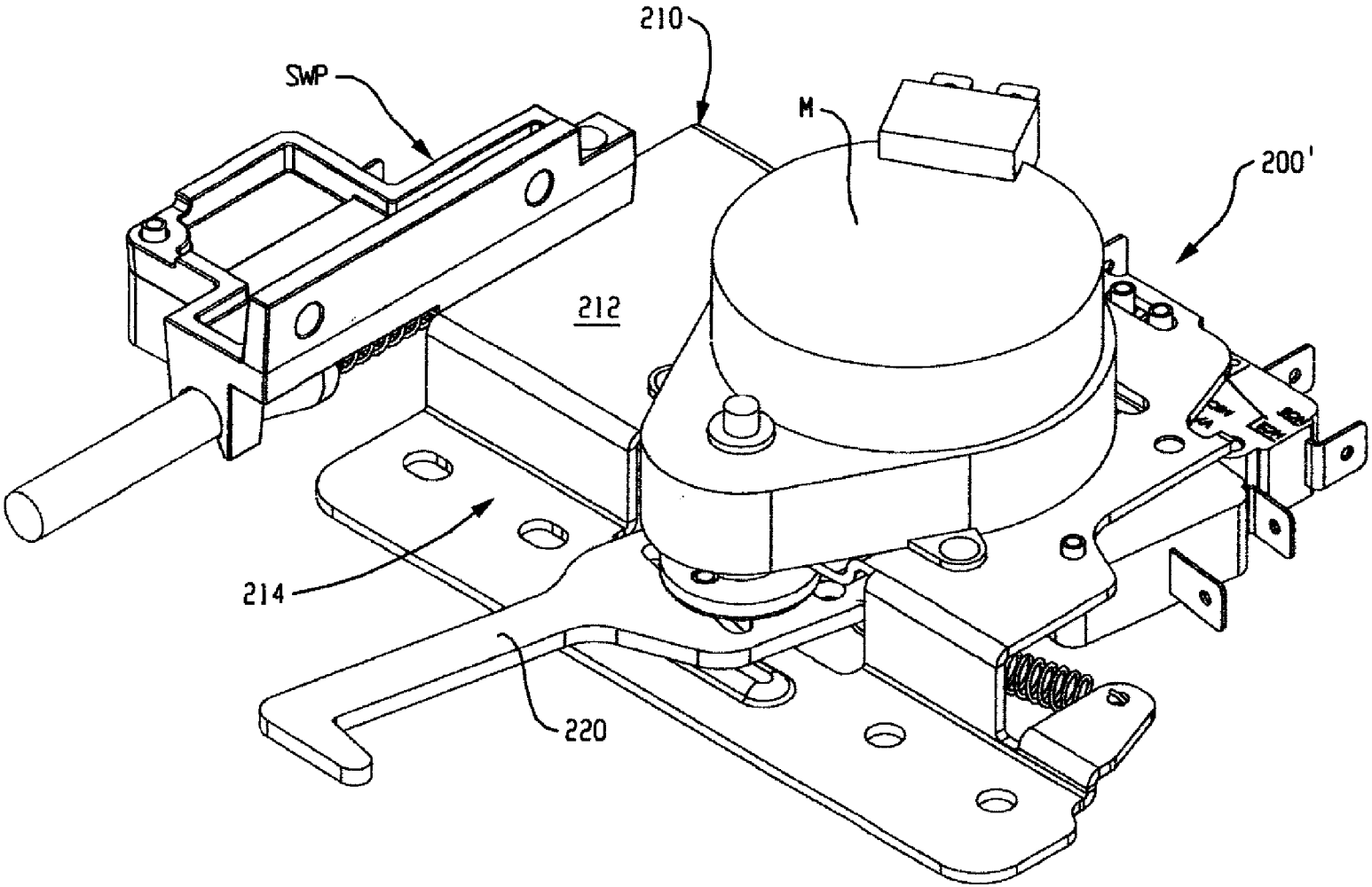
FIGS. 12A and 12B are isometric and bottom views of a modified version of the motorized oven door latch of FIGS. 7 and 8.
Figure 12B:
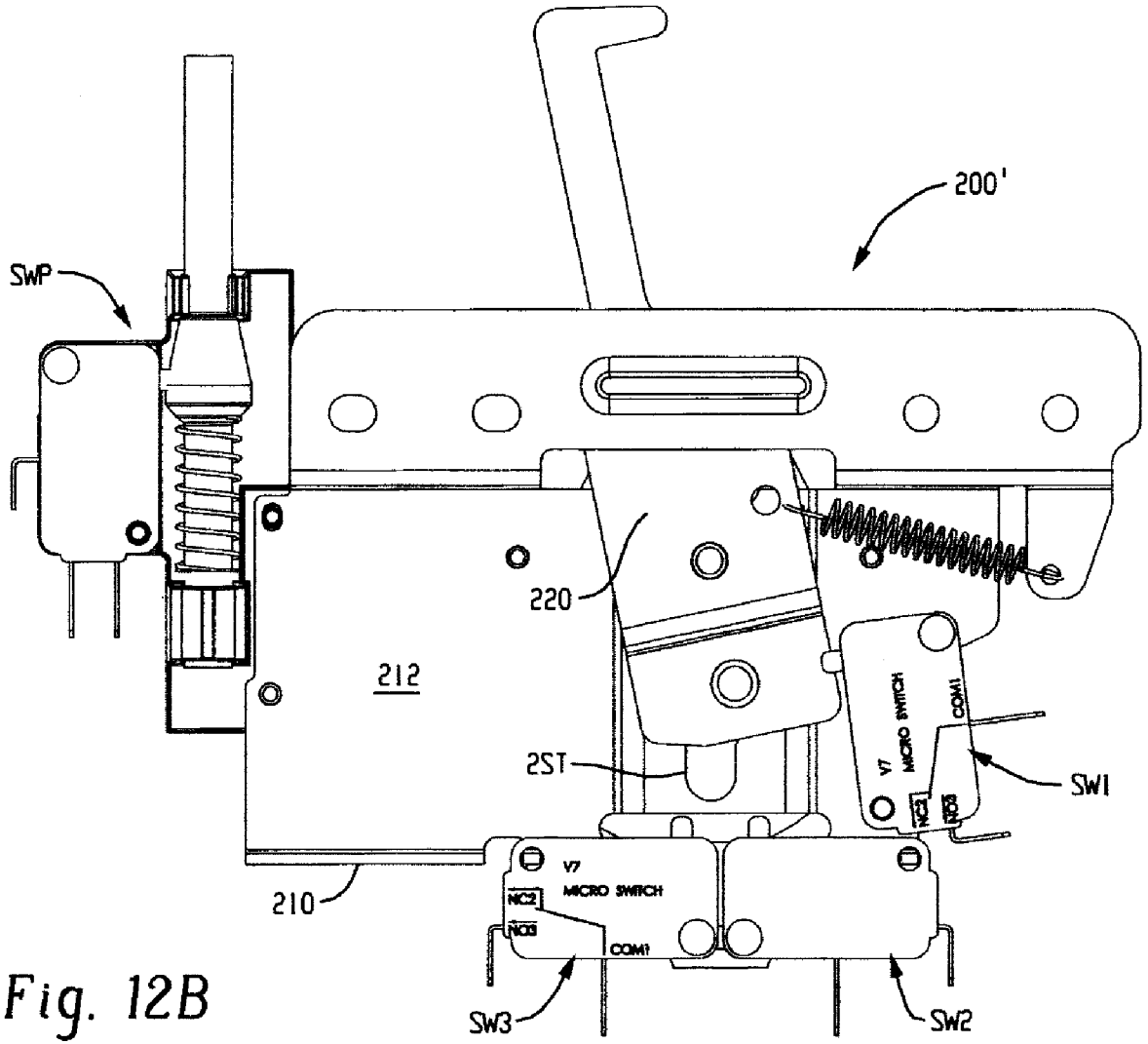

FIGS. 12A and 12B are isometric and bottom views that illustrate a motorized oven door latch 200' that is similar to the motorized oven door latch 200 in all respects but further includes a plunger switch SWP (as described above) mounted to the central portion 212 of the base plate 210 by rivets or other fasteners or other means.

One example of a suitable electric motor M is a Class F, 50/60 HZ, 4 watt permanent magnet synchronous motor. Suitable switches SW1,SW2,SW3 include, e.g., a micro or snap action switch, 5 amp, 120 VAC, 150 gm max operating force.

The development has been described with reference to preferred embodiments, but it should not be limited to these preferred embodiments. Instead, the invention should be construed in the broadest possible manner allowed by law both literally and according to the doctrine of equivalents.

The invention claimed is:

1. An oven latch comprising:

a base plate;

a latch member slidably connected to said base plate by first and second mounting studs connected to said latch member and located in a contoured slot defined in the base plate, said latch member comprising an inner end and an outer end;

a motor drivingly coupled to the latch member, said motor selectively operative to move the latch member forward and rearward relative to said base plate between a locked position and an unlocked position, wherein said latch member moves on a non-linear path relative to said base plate in response to movement of said first and second mounting studs in said contoured slot when said motor moves said latch member forward to said unlocked position or rearward to said locked position;

wherein one of said first and second mounting studs is located in an enlarged region of said contoured slot when said latch member is in its locked position, and wherein said one of said first and second mounting studs moves angularly in the enlarged region about the other of said first and second mounting studs in response to manual movement of said outer end of said latch member to a manual unlock position.

2. The oven latch as set forth in claim 1, wherein said latch member is located adjacent a first side of said base plate and said first and second mounting studs comprise respective first and second enlarged heads located adjacent an opposite second side of said base plate, and wherein respective shanks of said first and second mounting studs are connected respectively to said first and second enlarged heads and extend through said contoured slot and are secured to said latch member, with said base plate located between said latch member and said first and second enlarged heads.

3. The oven latch as set forth in claim 1, further comprising a spring connected between said base plate and said latch member, wherein said spring resiliently counteracts movement of said outer end of said latch member to said manual unlock position when said latch member is in said locked position.

4. The oven latch as set forth in claim 3, further comprising at least one electrical switch connected to said base plate and adapted to be selectively operated by said latch member in response to said latch member moving to and between its locked and unlocked positions.

5. The oven latch as set forth in claim 1, wherein said motor comprises a drive shaft, said oven latch further comprising an output link connected to said drive shaft so that said output link rotates when said drive shaft rotates, wherein said output link is coupled to said latch member such that rotation of said output link moves said latch member between said locked position and said unlocked position.

6. The oven latch as set forth in claim 5, wherein said latch member comprises a drive slot and said output link comprises a drive pin connected thereto and eccentrically located relative to said drive shaft, wherein said drive pin is slidably located in said drive slot.

7. The oven latch as set forth in claim 6, wherein said drive slot is located adjacent said inner end of said latch member and extends transverse relative to a longitudinal axis of the latch member.

8. The oven latch as set forth in claim 6, wherein said drive slot is located in a central region of said latch member, between said inner and outer ends, and extends transverse relative to a longitudinal axis of the latch member.

9. A motorized oven latch comprising:

a base plate comprising a contoured slot;

a latch member movably connected to the base plate, said latch member movable between a locked position and an unlocked position and comprising an inner end and an outer end, wherein said outer end comprises a hook portion;

first and second mounting studs connected to the latch member and slidably located in said contoured slot, wherein: (i) outward sliding movement of said first and second mounting studs on a non-linear path in said contoured slot in response to movement of said latch member in an unlocking direction moves said latch member from said locked position to said unlocked position; and, (ii) inward sliding movement of said first and second mounting studs on the non-linear path in said contoured slot in response to movement of said latch member in a locking direction moves said latch member from said unlocked position to said locked position;

a motor connected to said base plate and operatively coupled to said latch member to selectively move said latch member in said unlocking and locking directions such that said latch member moves to and between its unlocked and locked positions in response to movement of said first and second mounting studs in said contoured slot wherein one of said first and second mounting studs is located in an enlarged region of said contoured slot when said latch member is in its locked position, and wherein said one of said first and second mounting studs pivots about the other of the first and second mounting studs in response to manual movement of said outer end of said latch member to a manual unlock position.

10. The motorized oven latch as set forth in claim 9, further comprising a spring connected between said base plate and said latch member, wherein said spring resiliently counteracts movement of said outer end of said latch member to said manual unlock position when said latch member is in said locked position.

11. The motorized oven latch as set forth in claim 10, further comprising at least one electrical switch connected to said base plate and adapted to be selectively operated by said latch member in response to said latch member moving to and between its locked and unlocked positions.

12. The motorized oven latch as set forth in claim 11, wherein said at least one electrical switch comprises first and second electrical switches each connected to said base plate and selectively actuated by said latch member in said locked and unlocked positions, respectively.

13. The motorized oven latch as set forth in claim 11, further comprising a plunger electrical switch connected to said base plate and comprising a spring-biased plunger adapted to be contacted by the associated oven door.

14. The motorized oven latch as set forth in claim 9, wherein said motor comprises a drive shaft and said motorized oven latch further comprises an output link connected to said drive shaft so that said output link rotates when said drive shaft rotates, wherein said output link is coupled to said latch member such that rotation of said output link moves said latch member between said locked position and said unlocked position.

15. The motorized oven latch as set forth in claim 14, wherein said latch member comprises a drive slot and said output link comprises a drive pin connected thereto and eccentrically located relative to said drive shaft, wherein said drive pin is slidably located in said drive slot.

16. The motorized oven latch as set forth in claim 15, wherein said drive slot is located adjacent said inner end of said latch member and extends transverse relative to a longitudinal axis of the latch member.

17. The motorized oven latch as set forth in claim 15, wherein said drive slot is located in a central region of said latch member, between said inner and outer ends, and extends transverse relative to a longitudinal axis of the latch member.

18. The motorized oven latch as set forth in claim 9, wherein said latch member is located adjacent a first side of said base plate and said first and second mounting studs comprise respective first and second enlarged heads located adjacent an opposite second side of said base plate, and wherein the respective shanks of said first and second mounting studs are connected respectively to said first and second enlarged heads and extend through said contoured slot and are secured to said latch member, with said base plate located between said latch member and said first and second enlarged heads.

* * * * *